US006478573B1

(12) United States Patent
Chian

(10) Patent No.: US 6,478,573 B1
(45) Date of Patent: Nov. 12, 2002

(54) ELECTRONIC DETECTING OF FLAME LOSS BY SENSING POWER OUTPUT FROM THERMOPILE

(75) Inventor: Brent Chian, Plymouth, MN (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/448,000

(22) Filed: Nov. 23, 1999

(51) Int. Cl.[7] ..... F23N 5/20

(52) U.S. Cl. ..... 431/6; 431/15; 431/27; 431/78

(58) Field of Search ..... 431/6, 15, 59, 431/80, 79, 14, 27

(56) References Cited

U.S. PATENT DOCUMENTS

| | | | | | |
|---|---|---|---|---|---|
| 3,301,307 | A | * | 1/1967 | Nishigaki et al. | 431/6 |
| 3,877,002 | A | * | 4/1975 | Cheal et al. | 340/258 |
| 4,583,936 | A | * | 4/1986 | Krieger | 431/12 |
| 4,639,598 | A | | 1/1987 | Kern et al. | |
| 4,639,717 | A | * | 1/1987 | DeMeirsman | 431/79 |
| 4,696,639 | A | * | 9/1987 | Bohan, Jr. | 431/59 |
| 4,734,658 | A | * | 3/1988 | Bohan, Jr. | 331/117 R |
| 4,770,629 | A | * | 9/1988 | Bohan, Jr. | 431/59 |
| 4,778,378 | A | | 10/1988 | Dolnick et al. | |
| 4,846,668 | A | * | 7/1989 | Bierle et al. | 431/173 |
| 4,951,870 | A | * | 8/1990 | Ballard et al. | 431/68 |
| 4,988,884 | A | | 1/1991 | Dunbar et al. | |
| 5,023,816 | A | * | 6/1991 | Patton et al. | 431/18 |
| 5,077,550 | A | * | 12/1991 | Cormier | 431/79 |
| 5,236,328 | A | * | 8/1993 | Tate et al. | 431/79 |
| 5,381,298 | A | * | 1/1995 | Shaw et al. | 307/108 |
| 5,625,342 | A | | 4/1997 | Hall et al. | |
| 5,798,946 | A | * | 8/1998 | Khesin | 431/12 |
| 5,822,200 | A | * | 10/1998 | Stasz | 323/906 |
| 5,931,655 | A | * | 8/1999 | Maher, Jr. | 431/59 |
| 5,984,663 | A | * | 11/1999 | Joyce | 431/76 |
| 6,045,353 | A | * | 4/2000 | VonDrasek et al. | 431/79 |

FOREIGN PATENT DOCUMENTS

| | | | |
|---|---|---|---|
| JP | 54174051 | 6/1981 | |
| JP | 61309603 | 5/1988 | |
| JP | 06317320 | * 11/1994 | 431/80 |
| JP | 06317321 | * 11/1994 | 431/80 |

* cited by examiner

*Primary Examiner*—James C. Yeung
(74) *Attorney, Agent, or Firm*—Kris T. Fredrick

(57) ABSTRACT

An apparatus for and method of rapidly detecting a flame out condition. A thermopile receives heat energy from the flame and generates electrical power to enable operation of a microprocessor. This microprocessor periodically measures the output voltage of the thermopile at one second intervals. An average is taken of eight consecutive samples. A running history of eight averages is stored within a FIFO which serves as a history queue. This FIFO thus stores a digitized signature of the flame condition over the previous 64 seconds. Analysis by the microprocessor is able to make an early detection of the flame out condition be utilizing the current voltage measurement sand the FIFO contents.

16 Claims, 6 Drawing Sheets

ELECTRONIC DETECTING OF FLAME LOSS BY SENSING POWER OUTPUT FROM THERMOPILE

CROSS REFERENCE TO CO-PENDING APPLICATIONS

U.S. patent application Ser. No. 09/447,999, filed Nov. 23, 1999 now U.S. Pat. No. 6,419,478, and entitled, "STEPPER MOTOR DRIVING A LINEAR ACTUATOR OPERATING A PRESSURE CONTROL REGULATOR"; U.S. patent application Ser. No. 09/450,078, filed Nov. 29, 1999 now U.S. Pat. No. 6,428,308, and entitled, "ELECTRONIC FUEL CONVERTIBILITY SELECTION"; and U.S. patent application Ser. No. 09/448,102, filed Nov. 23, 1999, and entitled, "LOW INPUT VOLTAGE, HIGH EFFICIENCY, DUAL OUTPUT DC TO DC CONVERTER"; are commonly assigned co-pending applications incorporated herein by reference.

BACKGROUND OF THE INVENTION

1. Field of the Invention

The present invention generally relates to systems for control of an appliance incorporating a flame and more particularly relates to flame management systems.

2. Description of the Prior Art

It is known in the art to employ various appliances for household and industrial applications which utilize a fuel such as natural gas (i.e., methane), propane, or similar gaseous hydrocarbons. Typically, such appliances have the primary heat supplied by a main burner with a substantial pressurized gas input regulated via a main valve. Ordinarily, the main burner consumes so much fuel and generates so much heat that the main burner is ignited only as necessary. At other times (e.g., the appliance is not used, etc.), the main valve is closed extinguishing the main burner flame.

A customary approach to reigniting the main burner whenever needed is through the use of a pilot light. The pilot light is a second, much smaller burner, having a small pressurized gas input regulated via a pilot valve. In most installations, the pilot light is intended to burn perpetually. Thus, turning the main valve on provides fuel to the main burner which is quickly ignited by the pilot light flame. Turning the main valve off, extinguishes the main burner, which can readily be reignited by the presence of the pilot light.

These fuels, being toxic and highly flammable, are particularly dangerous in a gaseous state if released into the ambient. Therefore, it is customary to provide certain safety features for ensuring that the pilot valve and main valve are never open when a flame is not present preventing release of the fuel into the atmosphere. A standard approach uses a thermogenerative electrical device (e.g., thermocouple, thermopile, solar cell, etc.) in close proximity to the properly operating flame. Whenever the corresponding flame is present, the thermocouple generates a current. A solenoid operated portion of the pilot valve and the main valve require the presence of a current from the thermocouple to maintain the corresponding valve in the open position. Therefore, if no flame is present and the thermocouple(s) is cold and not generating current, neither the pilot valve nor the main valve will release any fuel. U.S. Pat. No. 4,988,884, issued to Dunbar et al. shows a thermogenerative device thermally coupled to a flame.

In practice, the pilot light is ignited infrequently such as at installation, loss of fuel supply, etc. Ignition is accomplished by manually overriding the safety feature and holding the pilot valve open while the pilot light is lit using a match or piezo igniter. The manual override is held until the heat from the pilot flame is sufficient to cause the thermocouple to generate enough current to energize the safety solenoid. The pilot valve remains open as long as the thermocouple continues to generate sufficient current to actuate the pilot valve solenoid.

The safety thermocouple(s) can be replaced with a thermopile(s) or other device for generation of additional electrical power. This additional power may be desired for operating various indicators or for powering interfaces to equipment external to the appliance. U.S. Pat. No. 5,931,655, issued to Maher, Jr. and U.S. Pat. No. 4,778,378, issued to Dolnick et al. show generation and usage of such thermally generated power. However, upon loss of flame (e.g., from loss of fuel pressure), the thermocouple(s) ceases generating electrical current and the pilot valve and main valve are closed. The delay from loss of flame until closure of the valves depends upon a number of variables. Of greatest concern is the delay caused by heat energy retained in the appliance, including the thermopile(s). That means that as the size and current generation capacity of the thermopile(s) are increased, the system delays are correspondingly increased.

SUMMARY OF THE INVENTION

The present invention overcomes the disadvantages of the prior art by providing a method of and apparatus for providing an earlier indication of a flame out condition. In accordance with the preferred mode of the present invention, a thermopile is utilized to provide sufficient current to power a small microprocessor and a number of other electrical components. One of the functions of the microprocessor is to measure the output voltage of the thermopile and maintain a history of that voltage output. By comparing the instantaneous output voltage to the history, the microprocessor can diagnose a flame out condition from the voltage output signature much earlier than electrical current generation by the thermopile actually ceases.

The preferred embodiment employs a two stage low voltage DC-to-DC converter which converts the thermopile output to power the microprocessor and other electrical components.

Upon being powered up, the microprocessor samples the thermopile output voltage once every second. Every eight seconds an average is calculated. A complete "history" includes eight averages of eight readings each, covering the last 64 seconds. These readings are arranged in time through storage in a FIFO push down stack. That means that as each new average is calculated, it is entered into the location in the stack for the latest reading. All previous readings are shifted back one place in the stack. The $9^{th}$ last reading is shifted out of the stack and thus deleted.

The contents of the stack provide a signature of the output voltage versus time curve of the thermopile output. Using the algorithms described below in detail, the flame out condition can be detected much earlier than complete loss of thermopile output.

The thermopile has a certain internal resistance. In the preferred mode of practicing the invention, the main valve shares power from the same thermopile. When the main valve is turned on, the total thermopile output current increases resulting in a lowered thermopile output voltage. The microprocessor is notified of the mode change so that the algorithm can accommodate the mode change without falsely detecting a flame out condition.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
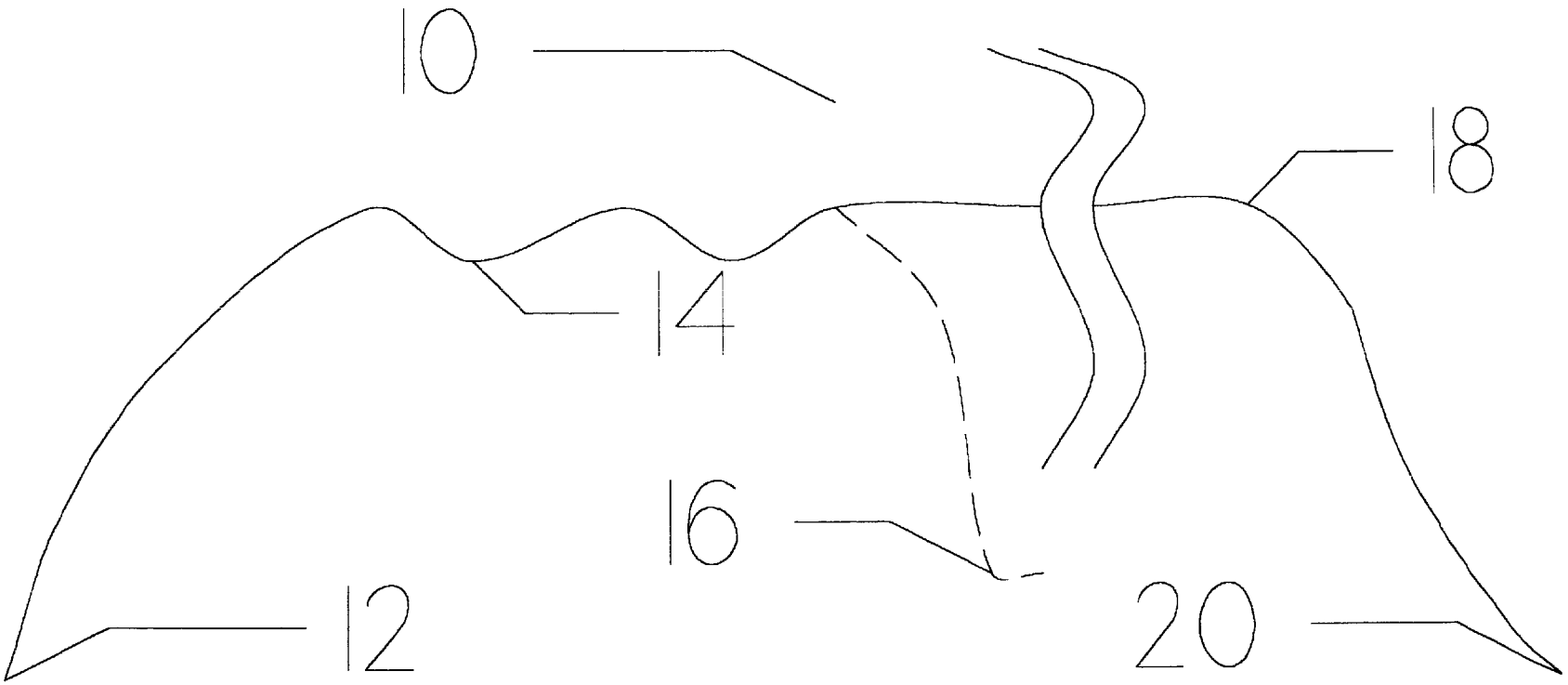
FIG. 1 is a graph showing the thermopile output voltage as a function of time.

FIG. 1 is a diagram 10 showing the output voltage versus time of the thermopile of the preferred mode of the present invention under various conditions. Shortly after flame on, point 12 is reached whereat the thermopile (not shown) begins generating a measurable voltage. The thermopile output is, of course, a function of the temperature within the combustion chamber (actually, as readily known to those of skill in the art, the output is a function of the temperature differential between the poles, only one of which is thermally coupled to the combustion chamber). The temperature of the combustion chamber (and hence the thermopile output) continues to rise over time until it reaches a relatively stable level having slight amplitude variations such as the relative minimum at point 14.

The system of the preferred mode has more than one flame level of the main burner. Point 16 represents the relatively stable level of a second mode (with lower flame energy input and output). A mode change is accomplished either automatically by a thermostat calling for heat, or manually by action of the user (e.g., a button on a remote control device). This mode change is communicated to the microprocessor as discussed in greater detail below to enable the microprocessor to differentiate mode change from flame out conditions.

Flame out occurs at point 18. Point 20 corresponds to a reduction in combustion chamber temperature at which the thermopile ceases to produce a measurable output. As can be seen by the curve of diagram 10 from point 18 to point 20, a characteristic signature is present. In accordance with the present invention, the microprocessor continuously and periodically measures the thermopile output such that this flame out signature can be detected well before point 20. Detecting flame out before loss of thermopile output provides available electrical energy for orderly shut down functions.

Figure 2:
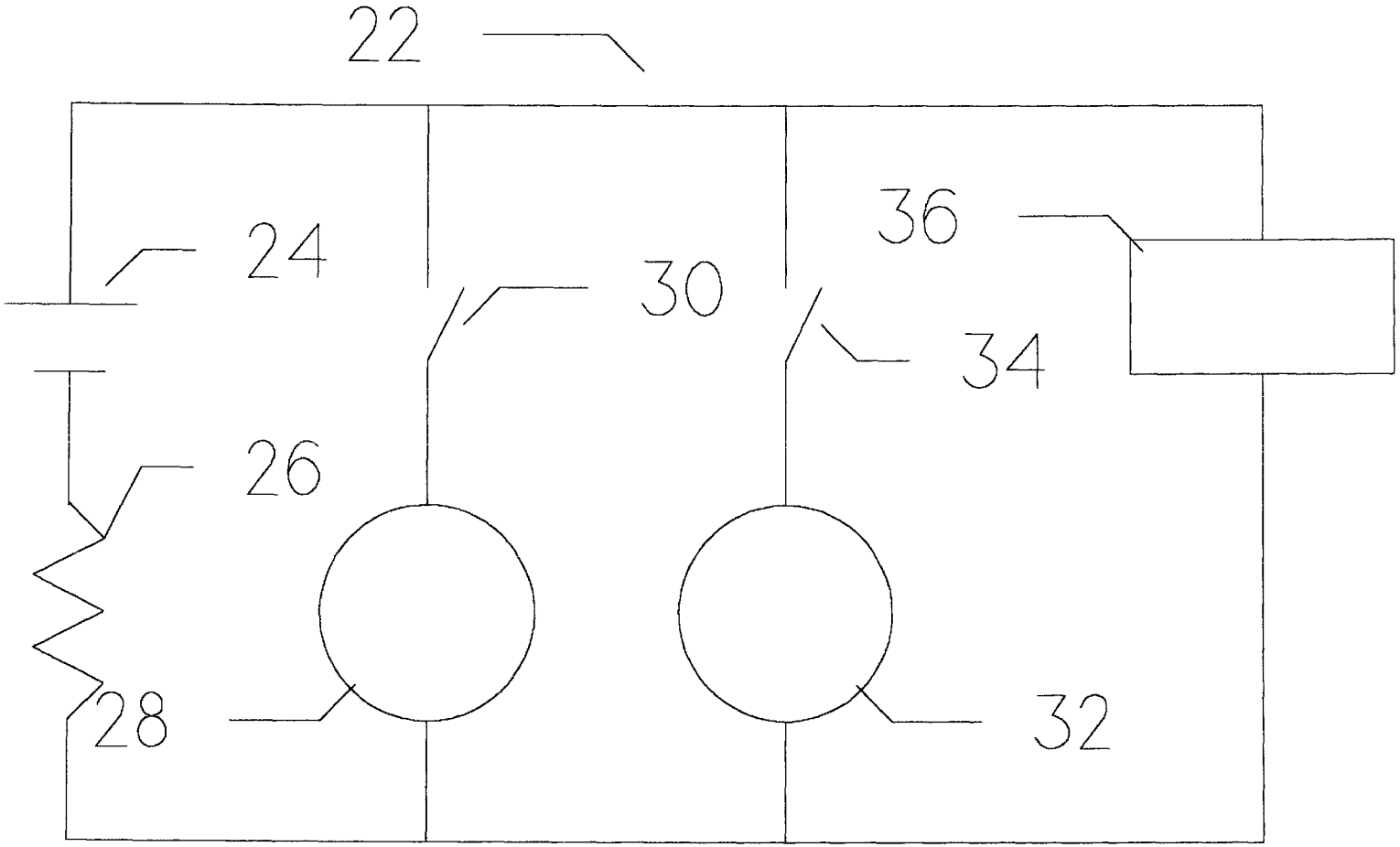
FIG. 2 is a simplified schematic electrical diagram of the present invention.

FIG. 2 is a very basic electrical diagram 22 of the power circuitry of the present invention.

Thermopile 24 is structured in accordance with the prior art. Resistor 26 represents the internal resistance of thermopile 24.

Pilot valve 28 has a solenoid (not separately shown) which holds the pilot valve closed whenever sufficient current flows through the circuit. Similarly, the internal solenoid (also not separately shown) of main valve 32 holds the main valve closed whenever sufficient current flows through the associated circuit.

DC-to-DC conversion facility 36 converts the relatively low voltage output of thermopile 24 to a sufficiently large voltage to power the electronic control circuitry, including the microprocessor. In accordance with the preferred mode of the present invention, DC-to-DC conversion facility 36 consists of two DC-to-DC converters. The first converter operates at the extremely low thermopile output voltages experienced during combustion chamber warm up to generate a higher voltage to start the high-efficiency, second DC-to-DC converter (see also FIG. 1). The other DC-to-DC converter, once started, can keep converting at much lower input voltage and generate much more power from the limited thermopile output for the system during normal operation. A more detailed description of these devices are available in the above identified and incorporated, commonly assigned, co-pending U.S. Patent Applications.

Figure 3:
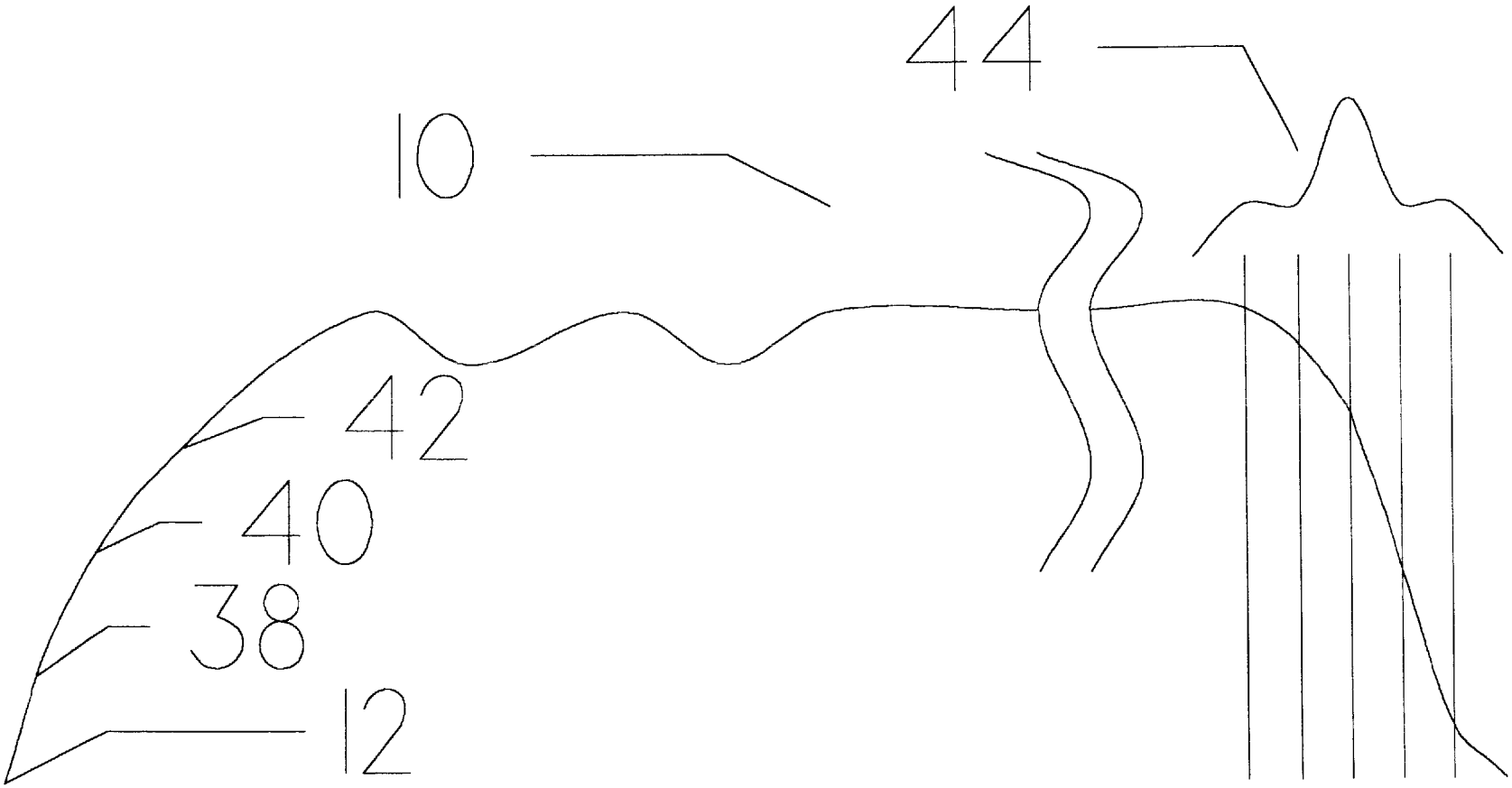
FIG. 3 is a graph, similar to FIG. 1, showing certain key points.

FIG. 3 is diagram 10 (see also FIG. 1) showing certain additional points of interest concerning the present invention. In accordance with the preferred mode, point 38 represents the point at which DC-to-DC conversion facility 36 (see also FIG. 2) begins producing useful electrical power. The above identified co-pending patent application describes the DC-to-DC converter in additional detail.

The output of the DC-to-DC converter begins to power the microprocessor such that it is fully operational at point 40. The time between points 40 and 42 is utilized by the microprocessor to initialize for full operation. This initialization includes setting various status registers and establishing certain initial conditions. Upon attaining full operation at point 42, the microprocessor begins to sample the thermopile output voltage as described below.

The thermopile output voltage value is converted to a ten bit digital quantity and sampled by the microprocessor once per second. The points in range 44 show how these samples can be used to describe the signature of the thermopile output voltage versus time profile.

Figure 4:
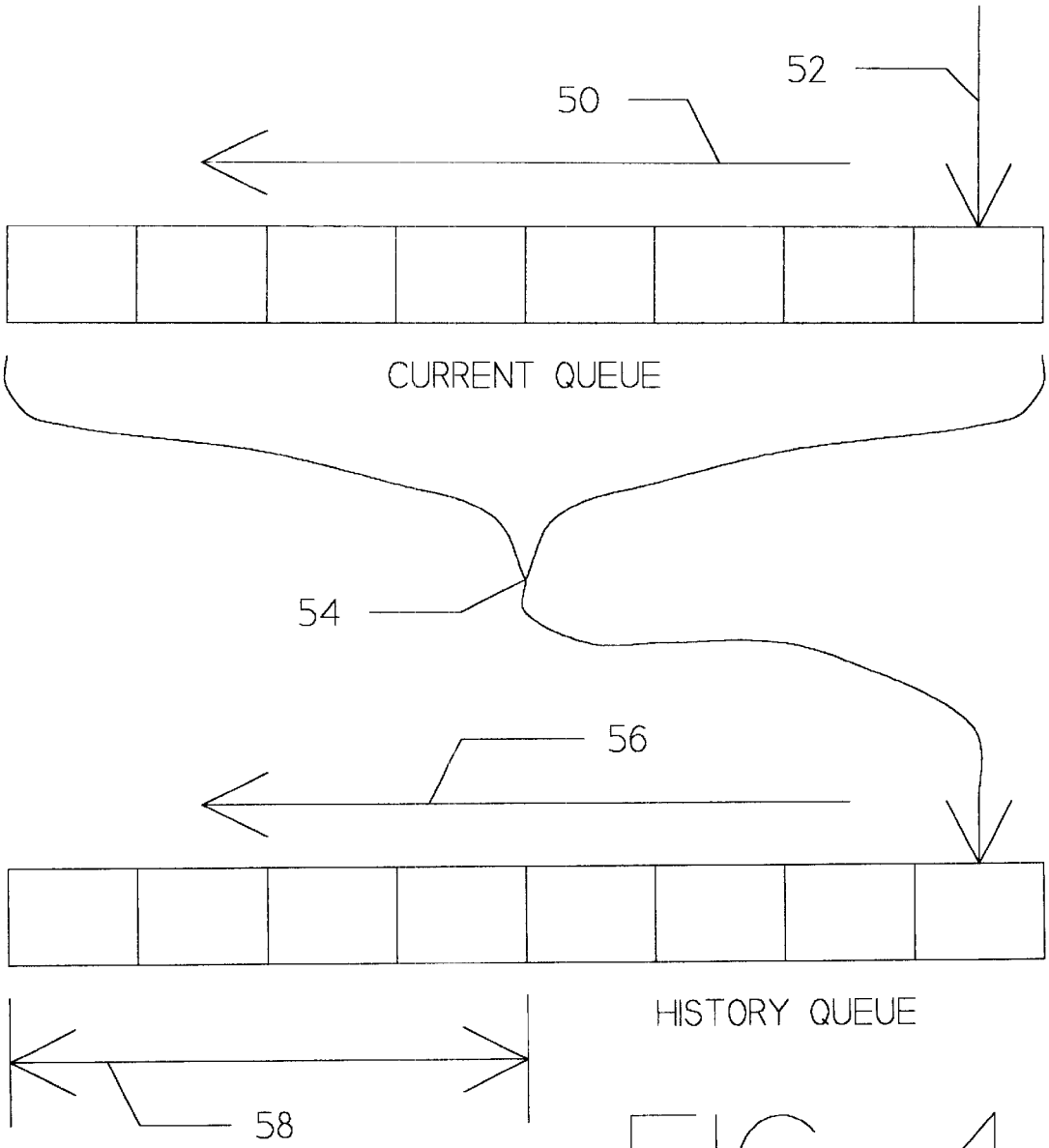
FIG. 4 is a schematic diagram showing operation of the memory which maintains the output voltage history.

FIG. 4 is a functional diagram of the memory which stores the samples of thermopile output voltage received by the microprocessor. This memory is arranged as an eight cell current queue and an eight cell history queue as shown. Each ten bit sample is presented along path 52. These samples are taken once per second and stored in succeeding cells represented by arrow 50. The current queue stores eight ten bit values. When all eight have been received representing the samples taken over an eight second period of time, the mathematical average of these eight samples is computed and transferred via path 54 to the history queue.

The history queue includes eight ten bit cells which are arranged as a FIFO with the older averages being shifted in the direction of arrow 56. Thus, the history queue can store eight different averages representing a period of 64 seconds. As is explained in more detail below, it is the history queue which stores the digitized signature of the flame condition over that 64 seconds. Portion 58 of the history queue contains the "old" average as described below.

Figure 5:
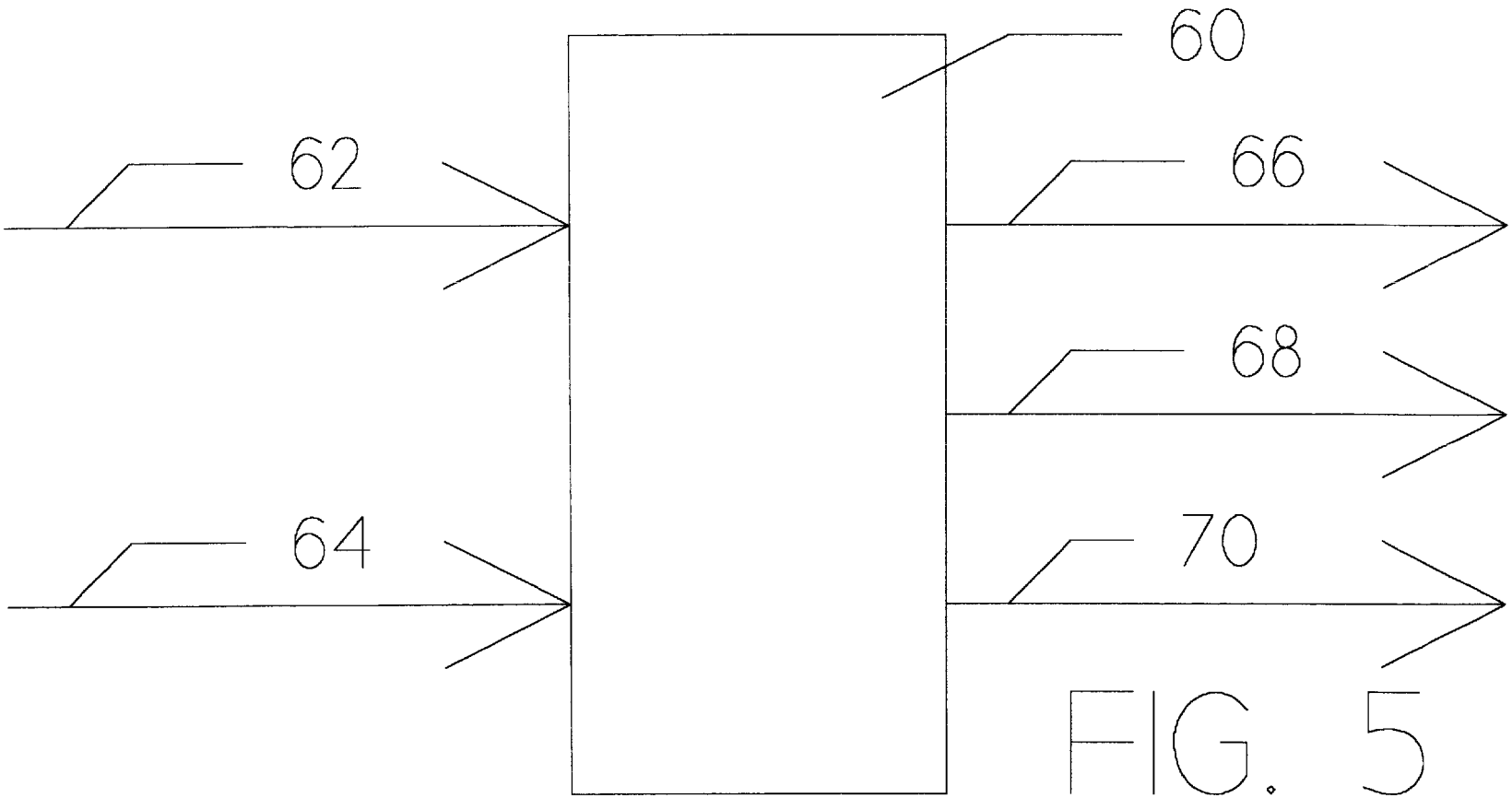
FIG. 5 is a basic diagram of the key inputs and outputs of the microprocessor.

FIG. 5 is a simplified diagram of microprocessor 60. In the preferred mode, microprocessor 60 is an 8-bit AVR model AT90LS8535 microprocessor available from ATMEL. It is a high performance low power, restricted instruction set (i.e., RISC) microprocessor. In the preferred mode, microprocessor is clocked at one megahertz to save power, even though the selected device may be clocked at up to four megahertz.

The two primary inputs to microprocessor 60 are the thermopile output voltage received via input 62 and the manual mode change information received via input 64. The thermopile output voltage is input once per second. The mode change information, on the other hand, is received a periodically in response to manual action by the user.

Figure 6:
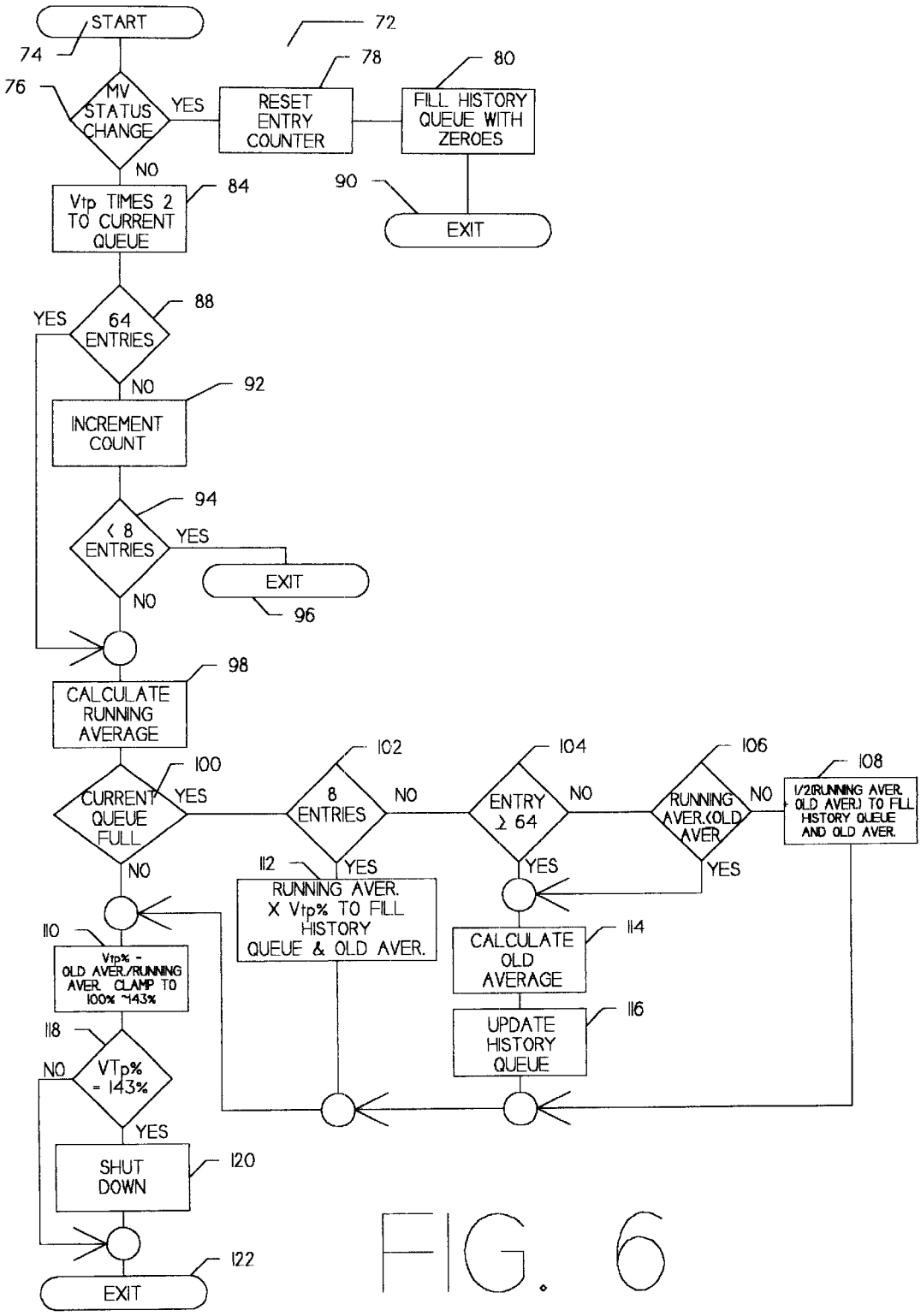
FIG. 6 is a detailed flow chart of the firm ware of the preferred mode of the present invention.

FIG. 6 is a flowchart 72 of the firm ware of the present invention which operates in microprocessor 60. At first start up Vtp% is initialized to 100%, and entry counter is set to zero. A "wake up" clock interrupts microprocessor 60 at one second intervals causing the program to start at element 74. Element 76 first determines whether there is a status change concerning the main fuel valve. As explained in reference to FIG. 1 point 16, such a status change involves a different thermopile load and therefore a different thermopile apparent output voltage. The program must be notified via path 64 (see also FIG. 5) of such status changes to prevent a false indication of flame out. It should be noted that the one second wake up interval is quick enough to accommodate the status change. If a main valve status change has occurred, element 78 resets the entry counter. Element 80 fills the current queue with all zeroes to start the analysis over again at the new input voltage. After that, control is given to element 90 for exit.

If element 76 has not detected a main valve status change, control is given to element 84 to secure the current thermopile output voltage value in the eight entry current queue. Element 88 determines if the history queue has a complete history, (i.e., eight averages which represent 64, seconds of Vtp values). If the history queue does not yet have eight entries, element 92 increments the counter. Control is given to element 94 which determines whether the current queue is full (i.e., eight entries). If no, control is given to element 96 for exit.

If the history queue has a complete history (i.e., eight averages representing non-zero entries over a 64 second period) or the current queue is full (i.e., eight non-zero entries), control is given to element 98 for calculation of the current running average. The use of this running average smooths the responses to compensate for the small variations always present (see point 14 of FIG. 1). Element 100 determines whether the current queue rolls over. If yes, control is given to element 102 to determine whether it is the first time the current queue rolls over. If yes, element 112 sets all of history queue entries to the running average times a percentage (Vtrp%) and control is returned to element 1 10 for further processing. If element 102 determines it is not the $8^{th}$ entry after start up or a mode change, control is given to element 104 which determines whether the history queue is full. If no, control is given to element 106 to determine if the new running average is less than the old average. If not, element 108 takes one half of the sum of the running average and the old average and fills the history queue with the result. If element 104 finds that the history queue is full or finds the current running average to be less than the old average, element 114 calculates the old average and element 116 updates the historical queue. Control is then given to element 110 for further processing.

Element 110 calculates the voltage percentage which equals the old average divided by the running average, and the result is clamped to 100%~143%. Control is then given to element 118 to determine if the percentage is equal to 143. If no, a shut down condition is not detected and the procedure exits at element 122. If yes, a shut down condition is detected and element 120 performs the shut down functions before exiting at element 122.

Having thus described the preferred embodiments of the present invention, those of skill in the art will be readily able to adapt the teachings found herein to yet other embodiments within the scope of the claims hereto attached.

I claim:

1. In a system having a flame thermally coupled to a device which generates an electrical output in response to heat energy received from said flame, the improvement comprising:

a. an electronic circuit which provides early detection of a flame out condition by comparing said electrical output to an assumed signature for said flame out condition; and b. wherein said electronic circuit is powered by said electrical output.

2. The improvement according to claim 1 wherein said device further comprises a microprocessor.

3. The improvement according to claim 2 wherein said device further comprises a thermopile.

4. The improvement according to claim 2 wherein said device further comprises a thermocouple.

5. An apparatus comprising:

a. a flame;

b. a device thermally coupled to said flame which generates an electrical output in response to heat received from said flame;

c. an electrical circuit responsively coupled to said electrical output which provides early detection of a flame out condition by sampling said electrical output;

d. wherein said electrical circuit further comprises a microprocessor; and e. wherein said microprocessor is powered by said electrical output.

6. An apparatus according to claim 5 wherein said microprocessor utilizes said sampling of said electrical output to produce a history of said electrical output provides early detection of said flame out condition by comparing said sampling of said electrical output with said history of said electrical output.

7. An apparatus according to claim 6 wherein said history is stored within a history queue.

8. A method of early prediction of a flame out condition in a system employing a flame comprising:

a. generating an electrical output in response to heat received from said flame;

b. sampling said electrical output to determine an amplitude;

c. continuing to sample said electrical output to produce an amplitude history;

d. comparing a current sample to said history; and e. assuming a flame out condition when said comparing step suggests a flame out.

9. A method according to claim 8 wherein said amplitude history contains samples which are a plurality of seconds apart.

10. A method according to claim 9 wherein said amplitude history contains a plurality of samples taken within a single second.

11. A method according to claim 10 wherein said plurality of samples taken within a single second further comprises eight.

12. A method according to claim 11 wherein said plurality of seconds further comprises eight seconds.

13. An apparatus for quickly detecting a flame out condition in a system having a flame comprising:

a. means thermally coupled to said flame for generating an electrical output in response to heat received from said flame having a flame out signature;

b. means responsively coupled to said generating means for sampling said electrical output;

c. means responsively coupled to said sampling means for detecting a flame out when said sampling indicates said flame out signature; and d. wherein said detecting means is powered by said generating means.

14. An apparatus according to claim 13 wherein said detecting means further comprises a microprocessor.

15. An apparatus according to claim 14 wherein said generating means further comprises a thermopile.

16. An apparatus according to claim 14 wherein said generating means further comprises a thermocouple.

* * * * *